US005928054A

United States Patent [19]

Mast

[11] Patent Number: 5,928,054

[45] Date of Patent: Jul. 27, 1999

[54] PLAYCENTER FOR BABIES

[76] Inventor: Lyle Mast, 11232 - 69 Street, Edmonton, Canada, T5B 1R5

[21] Appl. No.: 08/923,429

[22] Filed: Sep. 4, 1997

[51] Int. Cl.[6] ..... A63H 33/00; A63H 3/00

[52] U.S. Cl. ..... 446/227; 446/268; 446/486

[58] Field of Search ..... 446/71, 72, 73, 446/85, 220, 226, 227, 228, 268, 478, 486, 487, 490; 273/DIG. 2, DIG. 4, DIG. 8

[56] References Cited

U.S. PATENT DOCUMENTS

| | | | |
|---|---|---|---|
| 3,731,420 | 5/1973 | Crosman | 446/73 |
| 4,722,713 | 2/1988 | Williams et al. | 446/227 |
| 4,754,512 | 7/1988 | Chao-Yang | 446/73 X |
| 4,820,231 | 4/1989 | Mikitka et al. | 446/73 X |
| 4,853,994 | 8/1989 | Ekstein | 446/73 X |
| 4,934,981 | 6/1990 | Stulbach | 446/268 X |

FOREIGN PATENT DOCUMENTS

| | | | |
|---|---|---|---|
| 961000 | 6/1964 | Canada | 273/DIG. 8 |
| 2279265 | 1/1995 | United Kingdom . | |

*Primary Examiner*—D Neal Muir
*Attorney, Agent, or Firm*—Anthony R. Lambert

[57] ABSTRACT

A playcenter for babies includes, in combination, a resilient foam arch, play objects and a pouch into which the resilient foam arch may be folded for transport. The resilient foam arch is supported in a substantially vertical plane. The play objects are suspended from the resilient foam arch.

8 Claims, 2 Drawing Sheets

FIG. 1.
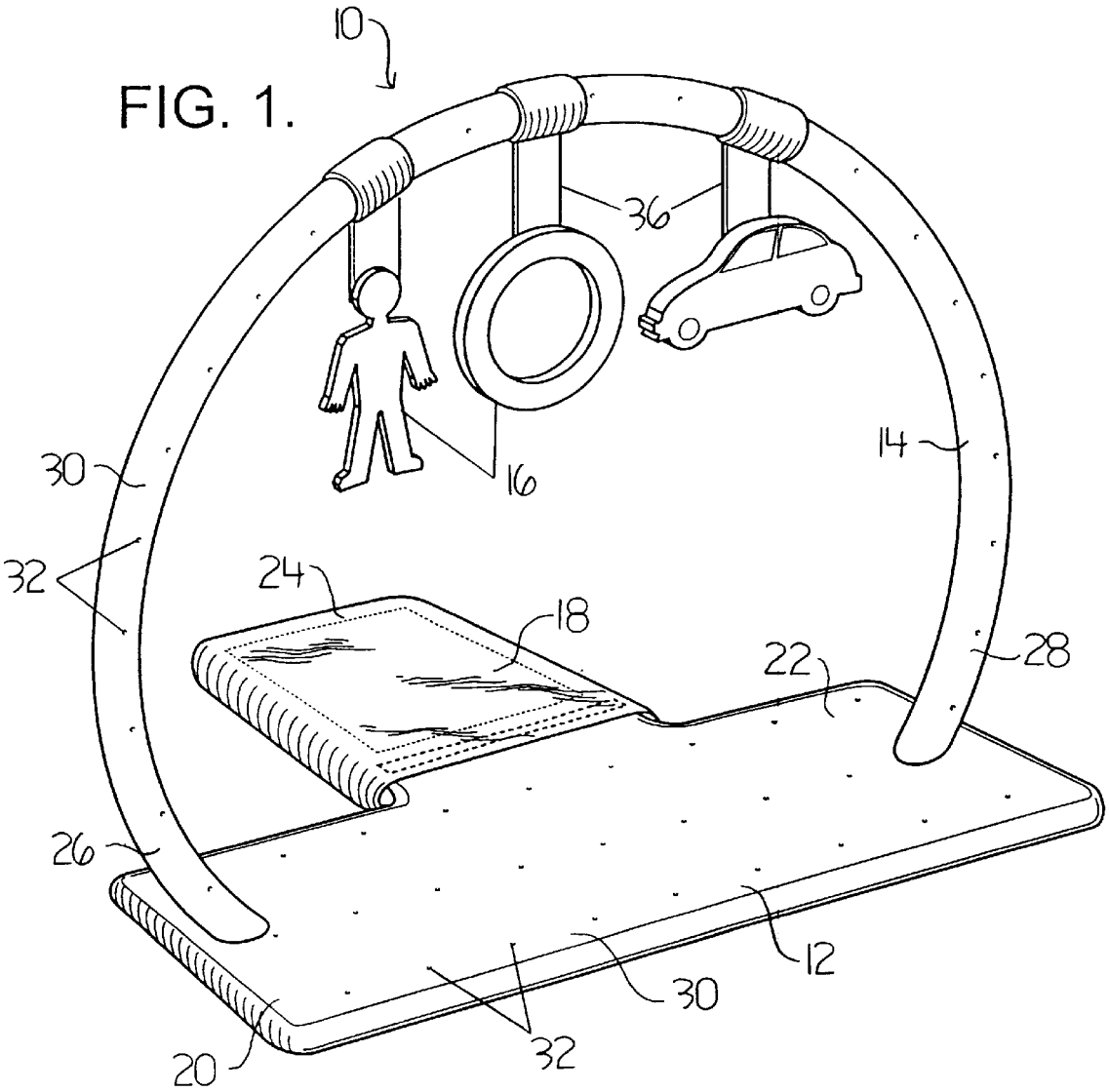
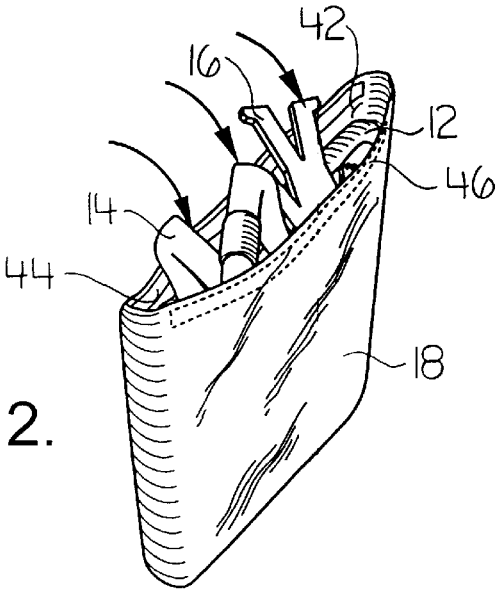
FIG. 2.

PLAYCENTER FOR BABIES

FIELD OF THE INVENTION

The present invention relates to a playcenter for babies and, in particular, babies who have not the ability to crawl.

BACKGROUND OF THE INVENTION

Playcenters are used to entertain babies, primarily, although not exclusively, babies who have not, as yet, developed the ability to crawl. They are intended to appeal to a baby's visual and tactile senses. They sometimes include sound emitting objects, which appeal to a baby's auditory senses. Those portions of the playcenters that may be placed in a baby's mouth, must be incapable of being swallowed or otherwise harming the baby.

Most playcenters consist of rigid polymer plastic housings that are intended to be secured together to form a suspended play area which is placed over a recumbent baby. They have a number of inherent drawbacks. They require assembly and disassembly and, as such, are not readily transportable to locations outside the home. They are bulky and hard to carry. They take time to set up. Children can be hurt by inadvertent impact with the rigid polymer plastic housing.

SUMMARY OF THE INVENTION

What is required is a readily transportable playcenter.

According to the present invention there is provided a playcenter for babies which includes, in combination, a resilient foam arch, play objects and a pouch into which the resilient foam arch may be folded for transport. Means is provided for supporting the resilient foam arch in a substantially vertical plane. Means is provided for suspending the play objects from the resilient foam arch.

The playcenter for babies, as described above, is capable of being transported in a compact pouch. When required, the resilient foam arch with play objects attached is removed from the pouch and used as required to entertain a baby.

The preferred means for supporting the resilient foam arch in a substantially vertical plane involves the use of a plinth-like resilient foam base upon which a baby may be laid. The resilient foam arch is secured substantially perpendicularly to the resilient foam base in a substantially vertical orientation.

The preferred means for suspending the play objects from the resilient foam arch is by straps.

BRIEF DESCRIPTION OF THE DRAWINGS

These and other features of the invention will become more apparent from the following description in which reference is made to the appended drawings, wherein:

FIG. 1 is a perspective view of a playcenter for babies constructed in accordance with the teachings of the present invention, in an operative position.

FIG. 2 is a perspective view of the playcenter for babies constructed in accordance with the teachings of the present invention, in a transport position.

DETAILED DESCRIPTION OF THE PREFERRED EMBODIMENT

Figure 3:
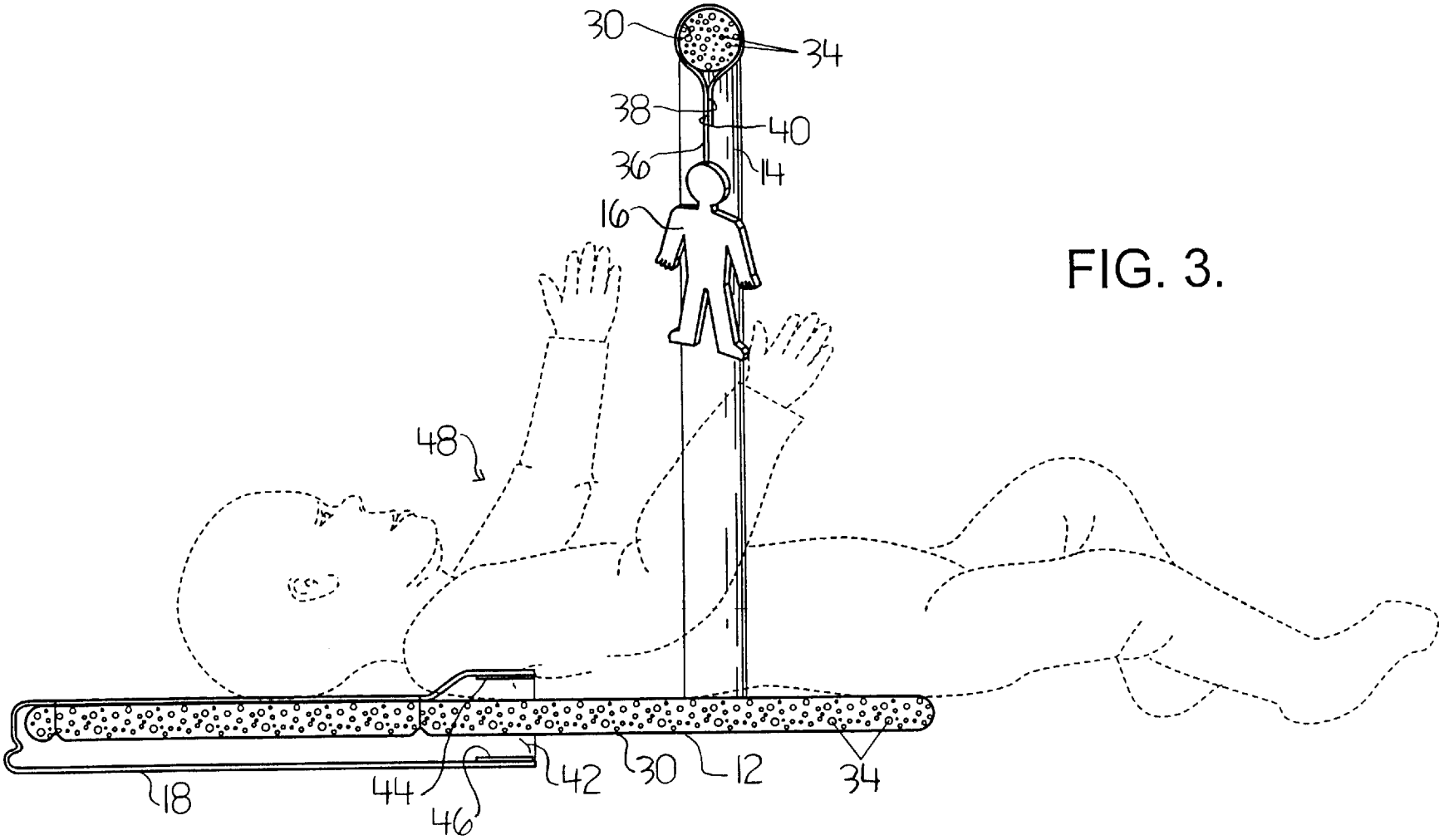
FIG. 3 is a side elevation view, in section, of the playcenter for babies illustrated in FIG. 1, in use by a baby.

The preferred embodiment, a playcenter for babies generally identified by reference numeral 10, will now be described with reference to FIGS. 1 through 3.

Referring to FIG. 1, playcenter 10 includes a resilient foam base 12, a resilient foam arch 14, a plurality of play objects 16, and a storage pouch 18. Resilient foam base 12 is plinth-like and in generally in the shape of a "T". Resilient foam base 12 has a first branch 20, a second branch 22, and a trunk 24. Resilient foam arch 14 is secured in a substantially vertical orientation to resilient foam base 12. Resilient foam arch 14 has a first end 26 which is secured to first branch 20 and a second end 28 which is secured to second branch 22. Both resilient foam base 12 and resilient foam arch 14 have a durable protective skin 30 that has air passages 32. Beneficial results have been obtained when polyurethane foam is used for durable protective skin 30. Polyurethane foam is easy to disinfect, is not easily punctured and has proven to be suitably durable and resilient. Referring to FIG. 3, both resilient foam base 12 and resilient foam arch 14 are made from foam that has a plurality of air pockets 34. Air pockets 34 are in fluid communication with air passages 32 which extend through protective skin 30. Play objects 16 are suspended by straps 36 from resilient foam arch 14. Straps 36 have mating tape fasteners 38 and 40 by means of which straps 36 are detachably secured to resilient foam arch 14. Storage pouch 18 is formed on trunk 24 of resilient foam base 12. Storage pouch 18 has an opening 42. Mating tape fasteners 44 and 46 are positioned in opening 42 and serve as the means by which storage pouch is maintained in a closed position.

The use and operation of playcenter 10 will now be described with reference to FIGS. 1 through 3. Playcenter 10 is illustrated in an operative position in FIGS. 1 and 3. Playcenter 10 is illustrated in a stored or transport position in FIG. 2. In order to alter playcenter 10 from an operative position to a stored or transport position, first branch 20, second branch 22, resilient foam arch 12 and play objects 16 are folded and stuffed into storage pouch 18. During the processing of folding, air is pressed from air pockets 34 through air passages 32 to facilitate compressing resilient foam base 12 and resilient foam arch 14 for the purpose of insertion into pouch 18. When playcenter 10 is required to entertain a baby, it is pulled from pouch 18. As soon as resilient foam base 12 and resilient foam arch 14 are no longer confined by storage pouch 18, air enters air pockets 34 through air passages 32 to reinflate resilient foam base 12 and resilient foam arch 14. As it inflates, resilient foam arch 14 returns to a substantially vertical orientation relative to resilient foam base 12. FIG. 3 illustrates a baby, generally indicated by reference numeral 48, positioned on resilient foam base 12 and playing with play objects 16 suspended from resilient foam arch 14.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A playcenter for babies, comprising in combination:

a resilient planar foam base;

a resilient foam arch having a first end and a second end;

the first end and the second end of the arch being secured to the base thereby supporting the resilient foam arch in a subtantially vertical plane;

play objects; and means for suspending the play objects from the resilient foam arch.

2. The playcenter for babies defined in claim 1, wherein a pouch is provided into which the resilient foam arch is folded for transport.

3. The playcenter for babies as defined in claim 1, wherein the means for suspending the play objects from the resilient foam arch includes straps.

4. A playcenter for babies, comprising in combination:

a plinth-like generally "T" shaped resilient foam base having a first branch, a second branch, and a trunk;

a resilient foam arch secured in a substantially vertical orientation to the resilient foam base, the resilient foam arch having a first end secured to the first branch and a second end secured to the second branch;

play objects suspended by straps from the resilient foam arch; and a pouch formed on the trunk of the resilient foam base, whereby the first branch, the second branch, the resilient foam arch and the play objects fold into the pouch for transport.

5. The playcenter for babies as defined in claim 4, wherein the straps having mating tape fasteners by means or which the straps are detachably secured to the resilient foam arch.

6. The playcenter for babies as defined in claim 4, wherein the resilient foam arch has a plurality of air pockets with air passages, such that air is pressed from the air pockets of the resilient foam arch to facilitate compressing the foam for the purpose of insertion into the pouch for transport and air enters the air pockets to self inflate the resilient foam arch causing the resilient foam arch to return to a vertical orientation once removed from the pouch.

7. The playcenter for babies as defined in claim 4, wherein the resilient foam arch has a durable protective skin.

8. A playcenter for babies, comprising in combination:

a plinth-like generally "T" shaped resilient foam base having a first branch, a second branch, and a trunk;

a resilient foam arch secured in a substantially vertical orientation to the resilient foam base, the resilient foam arch having a first end secured to the first branch and a second end secured to the second branch;

both the resilient foam base and the resilient foam arch have a durable protective skin, both the resilient foam base and the resilient foam arch use from having a plurality of air pockets which are in fluid communication with air passages extending through the protective skin;

play objects suspended by straps from the resilient foam arch, the straps having mating tape fasteners by means of which the straps are detachably secured to the resilient foam arch; and a pouch formed on the trunk of the resilient foam base, whereby the first branch, the second branch, the resilient foam arch and the play objects fold into the pouch for transport, air is pressed from the air pockets through the air passages to facilitate compressing the resilient foam base and the resilient foam arch for the purpose of insertion into the pouch for transport, air enters the air pockets to reinflate the resilient foam base and the resilient foam arch and cause the resilient foam arch to return to a vertical orientation once removed from the pouch.

* * * * *